US008801106B2

(12) United States Patent
Franklin et al.

(10) Patent No.: US 8,801,106 B2
(45) Date of Patent: Aug. 12, 2014

(54) CLEAT FOR JOINING CHASSIS MODULES

(75) Inventors: Shawn W. Franklin, Emlenton, PA (US); Ryan E. Perry, Venus, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 175 days.

(21) Appl. No.: 13/457,922

(22) Filed: Apr. 27, 2012

(65) Prior Publication Data

US 2013/0287485 A1 Oct. 31, 2013

(51) Int. Cl.
*E21C 35/00* (2006.01)
*E21C 27/02* (2006.01)

(52) U.S. Cl.
CPC ..... *E21C 27/02* (2013.01)
USPC ..... 299/42; 403/294

(58) Field of Classification Search
CPC ..... E21C 35/00; E21C 27/02
USPC ..... 299/42; 403/306, 294, 296
See application file for complete search history.

(56) References Cited

U.S. PATENT DOCUMENTS

| | | | | |
|---|---|---|---|---|
| 146,207 | A * | 1/1874 | Schneider | 403/293 |
| 1,823,971 | A | 9/1931 | Erlandson | |
| 3,099,051 | A | 7/1963 | Chenoweth | |
| 3,127,684 | A | 4/1964 | Ernst | |
| 3,716,146 | A | 2/1973 | Altherr | |
| 3,816,945 | A | 6/1974 | Egtvedt | |
| 4,050,588 | A | 9/1977 | Miller | |
| 4,282,979 | A | 8/1981 | Friedrichs | |
| 4,478,457 | A * | 10/1984 | Lanfermann | 299/18 |
| 4,479,575 | A | 10/1984 | Grundken et al. | |
| 4,658,952 | A | 4/1987 | Grundken et al. | |
| 4,668,122 | A | 5/1987 | Riddle | |
| 4,693,518 | A | 9/1987 | Sulosky et al. | |
| 4,702,658 | A | 10/1987 | Salter | |
| 4,733,771 | A * | 3/1988 | Grundken et al. | 198/735.6 |
| 4,919,566 | A | 4/1990 | Caron et al. | |
| 5,150,983 | A | 9/1992 | Bogenhagen | |
| 5,199,771 | A | 4/1993 | James et al. | |
| 5,333,557 | A * | 8/1994 | Eickhoff | 108/65 |

(Continued)

FOREIGN PATENT DOCUMENTS

| | | |
|---|---|---|
| DE | 2519239 | 11/1976 |
| DE | 2519270 | 11/1976 |

(Continued)

OTHER PUBLICATIONS

P-403685 Search Report dated Aug. 20, 2013 (2 pages).

*Primary Examiner* — John Kreck
(74) *Attorney, Agent, or Firm* — Michael Best & Friedrich LLP

(57) ABSTRACT

A shearer mining machine generally includes a first chassis module, a second chassis module, one or more cleats, and means for securing each cleat on the first and second chassis modules. The first chassis module has a first mating surface and a first opening spaced from the first mating surface. The first opening is defined by a first wedge-shaped module wall positioned adjacent the first mating surface. The second chassis module has a second mating surface and a second opening spaced from the second mating surface. Each cleat includes a first projection, a second projection, and a bridge portion extending between the first projection and the second projection. The first projection is received by the first opening and includes a wedge-shaped cleat wall for engagement with the first wedge-shaped module wall. The means for securing apply a clamp force normal to the wedge-shaped cleat wall.

21 Claims, 6 Drawing Sheets

(56) References Cited

U.S. PATENT DOCUMENTS

| | | | | |
|---|---|---|---|---|
| 5,442,976 | A | 8/1995 | Cheng | |
| 5,466,056 | A | 11/1995 | James et al. | |
| 5,533,796 | A | 7/1996 | Beeley | |
| 5,676,508 | A | 10/1997 | Weicht | |
| 5,683,198 | A | 11/1997 | Leutenegger | |
| 6,138,921 | A | 10/2000 | Espinosa | |
| 6,345,927 | B1 * | 2/2002 | Pao et al. | 403/294 |
| 7,530,758 | B2 * | 5/2009 | Bouru | 403/286 |
| 7,901,015 | B1 | 3/2011 | Anderson | |
| 8,602,502 | B2 * | 12/2013 | Niederriter et al. | 299/42 |
| 2002/0114667 | A1 | 8/2002 | Kaldenberg et al. | |
| 2003/0160431 | A1 | 8/2003 | Holmgren et al. | |
| 2013/0093236 | A1 * | 4/2013 | Marshall et al. | 299/10 |

FOREIGN PATENT DOCUMENTS

| | | | |
|---|---|---|---|
| DE | 2525913 | | 12/1976 |
| DE | 2616328 | | 11/1977 |
| DE | 3720869 | C1 | 1/1989 |
| DE | 3842236 | | 6/1990 |
| DE | 4215224 | | 8/1993 |
| DE | 20316360 | | 3/2004 |
| EP | 0894898 | | 2/1999 |
| FR | 2758509 | | 7/1998 |
| GB | 190309807 | | 0/1904 |
| GB | 190504144 | | 0/1905 |
| GB | 190816325 | | 0/1908 |
| GB | 255760 | | 7/1926 |
| GB | 1008863 | | 4/1962 |
| GB | 1418955 | | 12/1975 |
| GB | 1445885 | | 8/1976 |
| GB | 2110273 | | 6/1983 |
| PL | 165551 | B1 | 1/1992 |
| PL | 61722 | Y1 | 6/2003 |
| WO | 9427073 | | 11/1994 |

* cited by examiner

CLEAT FOR JOINING CHASSIS MODULES

BACKGROUND

In underground mining, shearer mining machines are commonly used. The shearer mining machine includes a generally rectangular box chassis and a pair of arms. Each of the arms is pivotally coupled to opposite ends of the chassis and supports a rotatable cutting drum. The rotatable cutting drums are equipped with teeth and remove material from a mining face. The shearer mining machine is mounted on an armored face conveyor for movement in a lateral direction substantially parallel to the mining face.

The chassis of the shearer mining machine typically includes three modules that are serially coupled. The middle module includes an electrical controller, and is abutted by side modules that house a tramming motor and geartrain for the shearer and other components such as hydraulic pumps, motors, control valves, and water piping. The three modules can be joined together at an inside of the chassis modules, by welding, bolting, or both.

SUMMARY

In operation while cutting material from the mining face, the chassis of the shearer mining machine is exposed to vibrations and cutting/haulage forces that the machine transmits. To bear the loads generated by the vibrations and cutting/haulage forces, the chassis modules are joined together at an inside of the chassis modules. For example, frames of the adjoining chassis modules can be clamped together with a number of bolts at an inside of the chassis modules. However, it may be cumbersome to join shearer chassis modules from an inside of the chassis compartments for example by bolting, because the joining area is not easily accessible. Maintenance of an internal joint may also be cumbersome for a similar reason. To gain access to the internal joints, the shearer chassis modules can include one or more cutouts or openings adjacent the joining area. Such cutouts, however, can create undesirable stress concentrations where cracking is likely to occur.

Shearer chassis modules may also be externally joined by welding. Such welding, however, can be cumbersome and time-consuming. For example, to weld the shearer chassis modules, weld preparations (e.g., recesses or grooves) are machined into the frame to lay steel straps therein as necessary and also to later provide a weld that is flush with adjoining portions of the chassis frame. In low-seam underground mining, the shearer mining machine may have a limited headroom or clearance from the chassis modules to canopies of powered roof supports on the mine roof. Thus, it is important for the weld not to project outwardly from the topside or underside of the chassis module, which would further limit the headroom or clearance. Providing a flush weld, however, requires machining that can be cumbersome and time-consuming. Moreover, to repair or rebuild welded chassis modules, the weld needs to be separated, weld preparations machined again, and then a new weld applied, all of which is also cumbersome and time-consuming. Furthermore, welding underground may not be allowed by applicable regulations, requiring the entire welded chassis to be transported underground in one piece, which may not be feasible depending on the size of the shearer mining machine or constraints of the mine infrastructure.

To more effectively withstand the loads generated by the vibrations and cutting/haulage forces without welding, flanges may be added around external perimeters of adjoining chassis modules for being bolted together. Such flanges, however, would be undesirable for a shearer chassis because the flanges may reduce the headroom or clearance. As described above, the shearer mining machine may have a limited headroom or clearance. A flange projecting outwardly from the topside of the chassis module would further reduce this limited headroom or clearance. On the underside of the chassis module, the outwardly projecting flange may restrict the flow of the mined material such as coal between the conveyor and the underside of the shearer chassis. Thus, there has developed a need for joining shearer chassis modules so as to suitably withstand loads generated by vibrations and cutting/haulage forces, yet without welding or adding flanges around external perimeters of adjoining chassis modules.

In some embodiments, a shearer mining machine generally includes a first chassis module, a second chassis module, and a cleat. The first chassis module has a first mating surface, a first outer surface, and a first opening spaced from the first mating surface and recessed with respect to the first outer surface. The first opening is defined by a first wedge-shaped module wall positioned adjacent the first mating surface. The second chassis module has a second mating surface, a second outer surface, and a second opening spaced from the second mating surface and recessed with respect to the second outer surface. The cleat includes a first projection, a second projection, and a bridge portion extending between the first projection and the second projection. The first projection is received by the first opening and includes a first wedge-shaped cleat wall for engagement with the first wedge-shaped module wall. The second projection is received by the second opening. Upon insertion of the first and second projections into the first and second openings, the first wedge-shaped module wall cooperates with the first wedge-shaped cleat wall to clamp the first and second mating surfaces together.

In other embodiments, a shearer mining machine generally includes a first chassis module, a second chassis module, one or more cleats, and means for securing each cleat on the first and second chassis modules. The first chassis module has a first mating surface and a first opening spaced from the first mating surface. The first opening is defined by a first wedge-shaped module wall positioned adjacent the first mating surface. The second chassis module has a second mating surface and a second opening spaced from the second mating surface. Each cleat includes a first projection, a second projection, and a bridge portion extending between the first projection and the second projection. The first projection is received by the first opening and includes a wedge-shaped cleat wall for engagement with the first wedge-shaped module wall. The second projection is received by the second opening. The means for securing apply a clamp force normal to the wedge-shaped cleat wall.

In still other embodiments, a cleat for joining chassis modules in a shearer mining machine generally includes a first projection, a second projection, and a bridge portion extending between the first projection and the second projection. The first projection includes a first wedge-shaped cleat wall.

In yet other embodiments, a shearer mining machine generally includes a pair of chassis modules and a cleat. The chassis modules are adjoining each other. Each chassis module defines a mating surface, an outer surface, and an opening spaced from the mating surface and recessed with respect to the outer surface. The openings are each defined by a wedge-shaped module wall positioned adjacent the mating surface. The cleat is insertable to the openings, and includes two projections and a bridge portion extending between the two projections. Each projection is received by the respective opening and includes wedge-shaped cleat walls for engagement with the respective wedge-shaped module walls. Upon insertion of the projections into the openings, the wedge-shaped module walls cooperate with the wedge-shaped cleat walls to clamp the mating surfaces together.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

Figure 1:
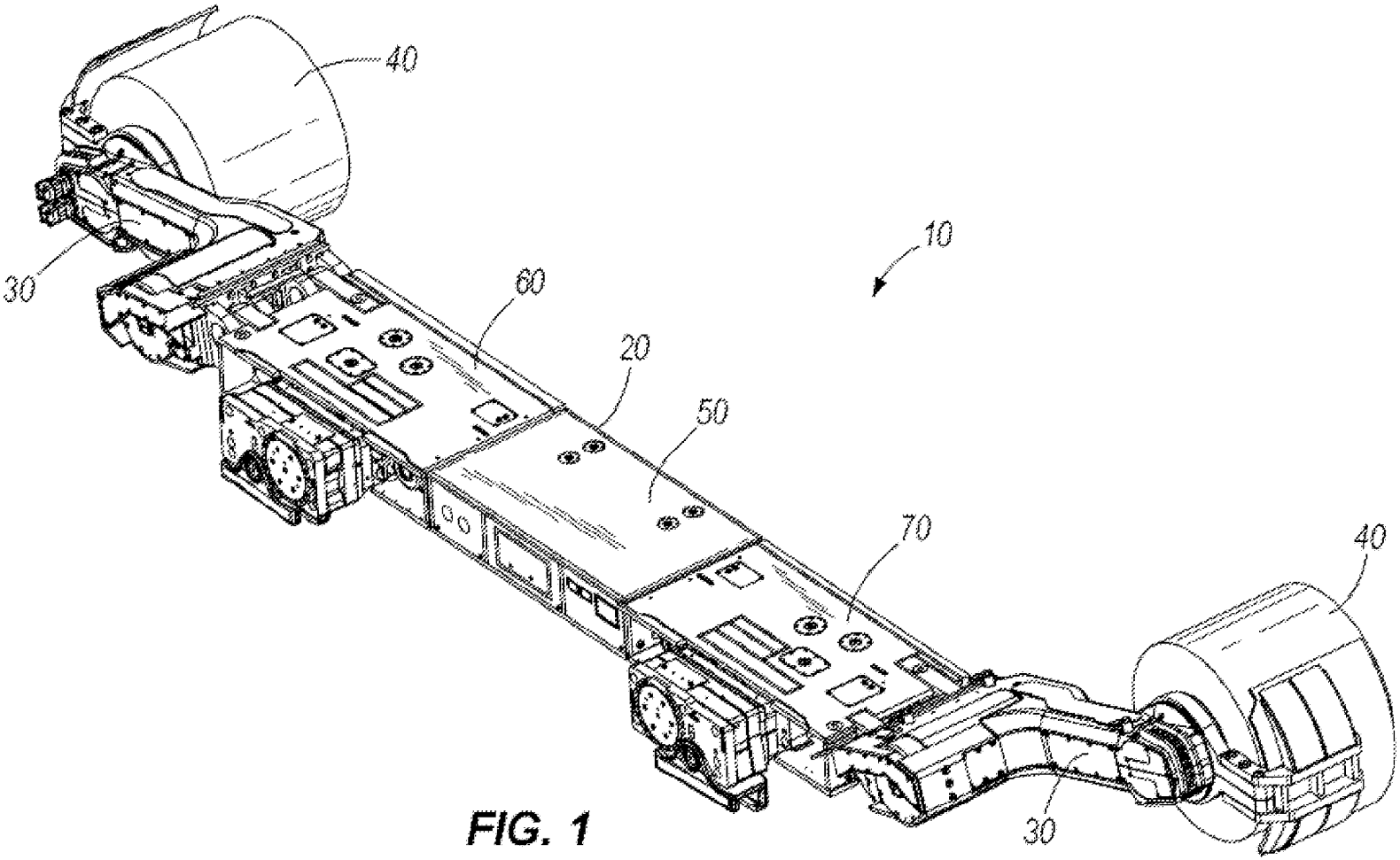
FIG. 1 is a perspective view of a shearer mining machine, illustrating serially coupled chassis modules.

FIG. 1 is a perspective view of a shearer mining machine 10. The shearer mining machine 10 includes a chassis 20 with a pair of movable arms 30, each arm 30 located at an opposite end of the chassis 20. Each arm 30 supports a rotatable cutting drum 40 including teeth (not shown) for removing material from a mining face (not shown). The chassis 20 is a generally rectangular box that measures longer in a lateral direction generally extending between the cutting arms 30, and shorter in a direction that is perpendicular to the lateral direction. The shearer mining machine 10 is mounted on an armored face conveyor (not shown) for movement in a lateral direction substantially parallel to the mining face. The illustrated chassis 20 of the shearer mining machine 10 includes three modules 50, 60, 70 that are serially coupled, including a middle module 50 and two side modules 60, 70. The middle module 50 is an electrical controller, which is abutted by the side modules 60, 70 that house a tramming motor and geartrain for the shearer 10 and other components such as hydraulic pumps, motors, control valves, and water piping.

Figure 2:
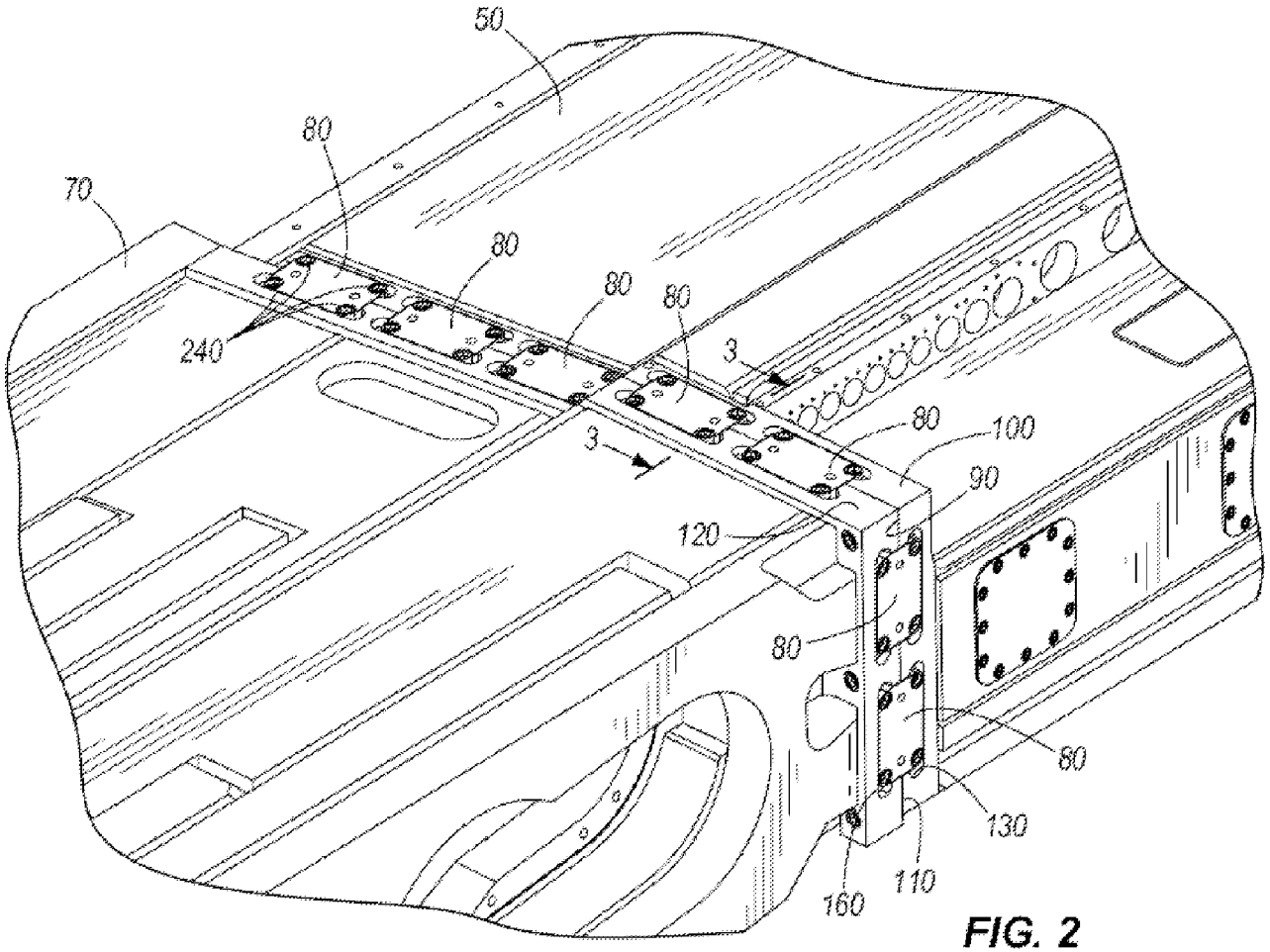
FIG. 2 is an enlarged partial perspective view of a shearer mining machine, illustrating cleats for joining chassis modules according to one embodiment of the invention.

FIG. 2 is an enlarged partial perspective view of the shearer mining machine 10 illustrating cleats or wedge blocks 80 for joining the chassis modules 50, 60, 70. For the purposes of the description, the joining of the modules is generally the same between the middle and side modules 50, 60, and the middle and side modules 50, 70, and will be described with reference to the middle and side modules 50, 70 shown in FIG. 2 with the same effect as the middle and side modules 50, 60 shown in FIG. 1. In the illustrated embodiment, the shearer mining machine 10 includes a plurality of cleats 80. In other embodiments, however, the shearer mining machine 10 may include a single cleat 80 for joining the middle and the modules 50, 70. The middle module 50 has a first mating surface 90 and a first outer surface 100. The side module 70 has a second mating surface 110 and a second outer surface 120. Each cleat 80 covers the first and second outer surfaces 100, 120 at least in part. The spacing of the cleats 80 or the spacing of the securing means 240 within the cleats 80 can be configured depending on the usage requirements or preferences for the particular shearer mining machine 10, e.g., to distribute or minimize stress concentrations, or achieve a desired total clamp force of the joint, as will be explained further below.

Figure 3:
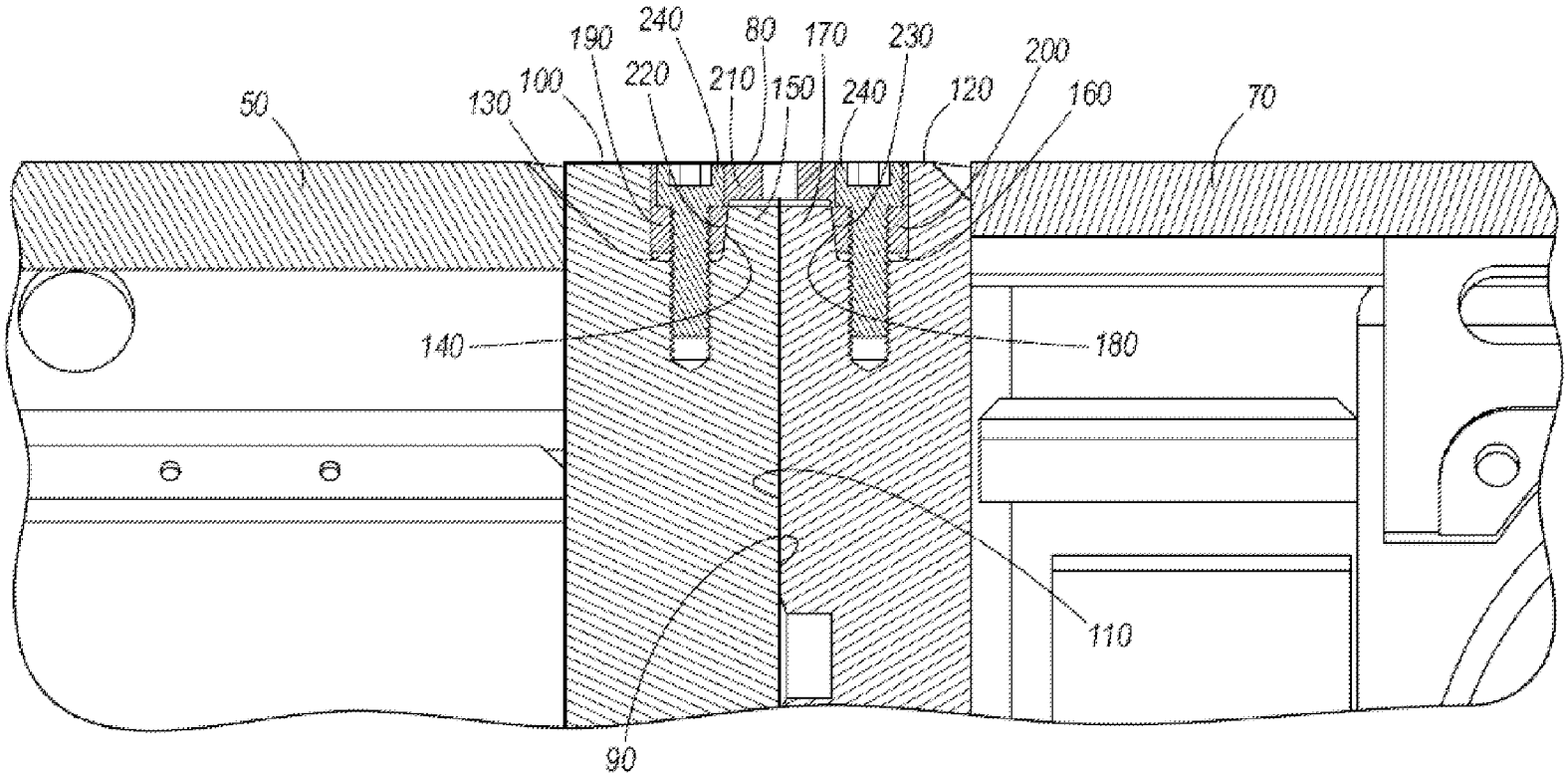
FIG. 3 is a cross-sectional view of the shearer mining machine taken along line 3-3 of FIG. 2.
Figure 4:
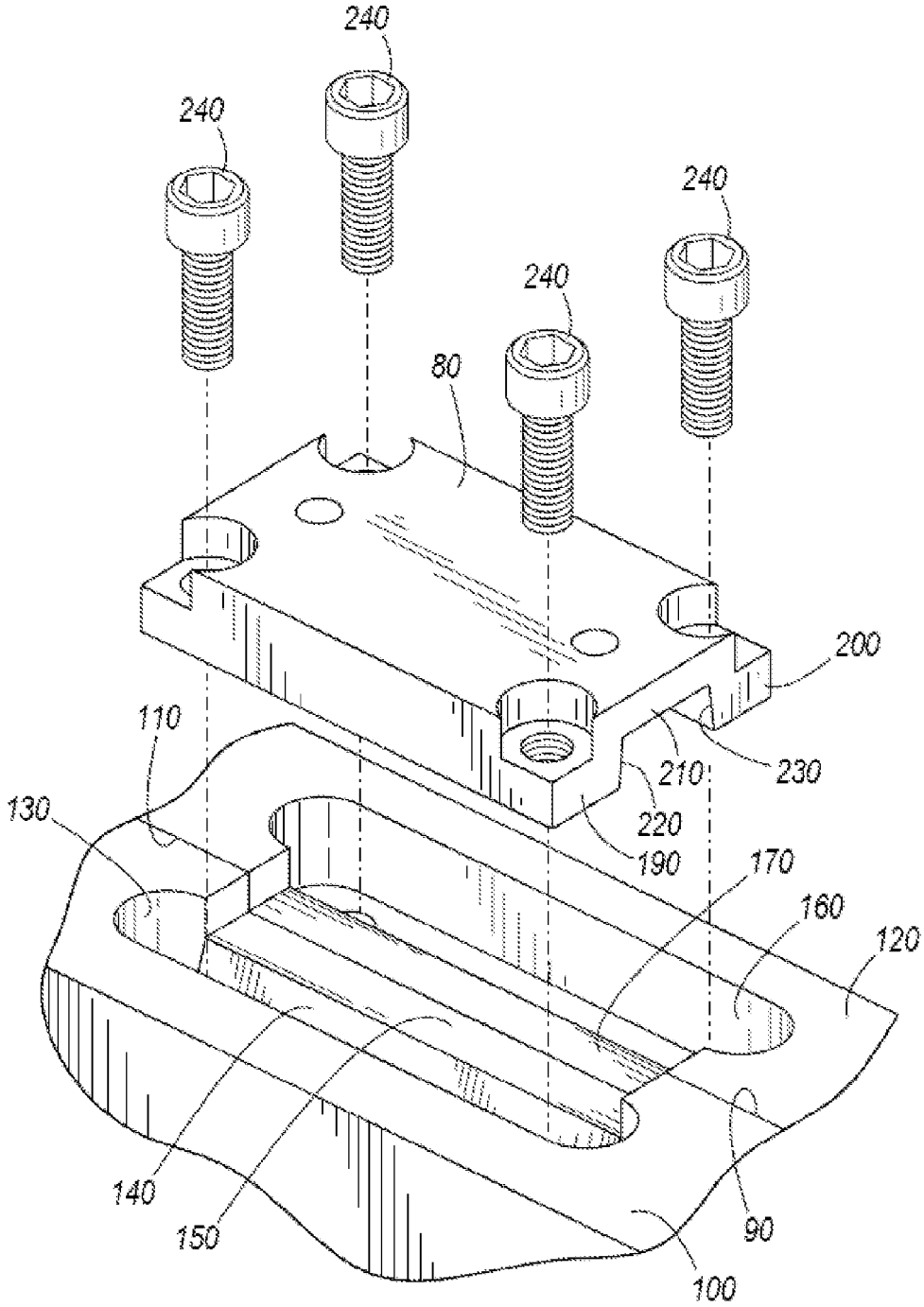
FIG. 4 is a perspective exploded view illustrating the cleat of FIG. 2 going into openings on the shearer mining machine.

FIG. 3 is a cross-sectional view of the shearer mining machine 10, illustrating a cleat 80 secured to the shearer mining machine 10. Referring also to FIG. 4, the middle module 50 has a first opening 130 spaced from the first mating surface 90 and recessed with respect to the first outer surface 100. The first opening 130 is defined by a first wedge-shaped module wall 140 positioned adjacent the first mating surface 90. Thus, the middle module 50 defines a first flange 150 extending between the first opening 130 and the first mating surface 90.

The side module 70 has a second opening 160 spaced from the second mating surface 110 and recessed with respect to the second outer surface 120. Thus, the side module 70 defines a second flange 170 extending between the second opening 160 and the second mating surface 110. In the illustrated embodiment, the second opening 160 is defined by a second wedge-shaped module wall 180 positioned adjacent the second mating surface 100. In other embodiments, however, the second module wall 180 is not wedge-shaped. For example, the second opening 160 may be defined by a module wall 180 that is joined to a bottom wall of the second opening 160 at a right angle.

In the illustrated embodiment, the first and second flanges 150, 170 are substantially symmetrical from a view along the first and second mating surfaces 90, 110. In other embodiments, however, the first and second flanges 150, 170 are not substantially symmetrical from a view along the first and second mating surfaces 90, 110. Moreover, although FIG. 3 illustrates the first and second wedge-shaped module walls 140, 180 as being substantially symmetrical from a view along the first and second mating surfaces 90, 110, in other embodiments the first and second wedge-shaped module walls 140, 180 are not substantially symmetrical from a view along the first and second mating surface 90, 110. In some embodiments, the first and second openings 130, 160 are of substantially the same height relative to the respective outer surfaces 100, 120. In other embodiments, however, the first and second openings 130, 160 are of different heights relative to the respective outer surfaces 100, 120. In some embodiments, the first and second openings 130, 160 are of substantially the same length. In other embodiments, however, the first and second openings 130, 160 are of different lengths.

The cleat 80 includes a first projection 190, a second projection 200, and a bridge portion 210 extending between the first projection 190 and the second projection 200. The first projection 190 is received by the first opening 130 in the middle module 50. The first projection 190 of the cleat 80 includes a wedge-shaped cleat wall 220 for engagement with the first wedge-shaped module wall 140. The second projection 200 of the cleat 80 is received by the second opening 160 in the side module 70. In the illustrated embodiment, the second projection 200 of the cleat 80 includes a second wedge-shaped cleat wall 230 for engagement with the second wedge-shaped module wall 180. The first and second wedge-shaped cleat walls 220, 230 can be substantially symmetrical from a view along the bridge portion 210. The first and second projections 190, 200 of the cleat 80 can also be substantially symmetrical from a view along the bridge portion 210. As described above, however, in some embodiments the second module wall 180 is not wedge-shaped. In such embodiments, the second cleat wall 230 is also not wedge-shaped. For example, the second cleat wall 230 may be joined to the bridge portion 210 at a right angle.

Upon insertion of the first and second projections 190, 200 into the first and second openings 130, 160, the first wedge-shaped module wall 140 cooperates with the first wedge-shaped cleat wall 220 to clamp the first and second mating surfaces 90, 110 together. The first and second flanges 150, 170 of the middle and side modules 50, 70, respectively, are positioned within the bridge portion 210 of the cleat 80 when the cleat 80 is secured to the middle and side modules 50, 70.

The shearer mining machine 10 also includes means for securing 240 each cleat 80 on the middle and side modules 50, 70. Each means for securing 240 applies a clamp force normal to the respective cleat wall 220, 230. In the embodiment shown, the means for securing 240 each cleat 80 is a fastener, and as specifically shown in the figures, a bolt or screw. A head portion of each screw 240 is easily accessible from the outside of the periphery of the middle and side modules 50, 70, because the screws 240 are exposed to the outside of the middle and side modules 50, 70. In contrast, if the bolts 240 were positioned internal to the middle and side modules 50, 70 the bolts 240 would not be easily accessible to screw in or to apply a proper amount of torque. In the illustrated embodiment, the first and second openings 130, 160 of the middle and side modules 50, 70, respectively, are machined so that the head portion of each screw 240 and an upper surface of the cleat 80 are flush with, or even slightly recessed relative to, the first and second outer surfaces 100, 120 when the cleat 80 is positioned in the first and second openings 130, 160. As such, the headroom or clearance from the topside of the middle and side modules 50, 70 to roof supports on the mine roof is not reduced. Moreover, the material flow on the underside of the middle and side modules 50, 70 is not impeded. FIG. 3 illustrates the means for securing 240 the cleat 80 as a fastener, and specifically a plurality of screws 240. In other embodiments, however, the cleats 80 may be secured to the middle and side modules 50, 70 using any suitable fasteners including for example welds or adhesives, or other fasteners that provide a compressive force.

Figure 5:
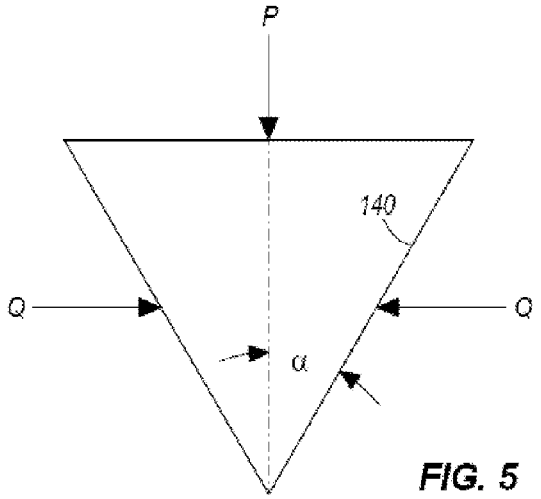
FIG. 5 is a free-body diagram illustrating how the cleat of FIG. 3 is used to clamp the chassis modules together.

FIG. 5 is a free-body diagram illustrating how the cleat 80 is used to clamp the middle and side modules 50, 70 together. For the purposes of the description, the free-body diagram is generally the same between a V-shaped cross-section shown in FIG. 5 and a trapezoidal cross-section defined by the bridge portion 210 of the cleat 80 shown in FIG. 3, and will be described with reference to the V-shaped cross-section shown in FIG. 5 with the same effect as the trapezoidal cross-section shown in FIG. 3. The securing means 240 are applied substantially parallel to the first and second mating surfaces 90, 110, applying a screw force P. In a typical bolted joint, the axial screw force of the bolt is perpendicular to the mated surfaces to be clamped. The illustrated wedge-shaped cleat wall 220, however, is inclined or tapered at a non-perpendicular angle relative to the direction to the screw force P. The resulting reaction force is normal to the wedge-shaped cleat wall 220 and thus angled relative to the screw force P, and includes a component Q in a direction substantially perpendicular to the first and second mating surfaces 90, 110. The clamp force Q tends to clamp the first and second mating surfaces 90, 110 together. The amount of clamp force Q depends on the screw force P, friction, and the taper angle α according to the following equation:

$$Q = \frac{P}{2 \tan \alpha} - (\text{frictional term}) \qquad [1]$$

Assuming that the frictional term is relatively constant for steel on steel, the two variables that affect the joint between the cleat 80 and the middle or side module 50, 70 are the screw force P and the taper angle α. The screw force P depends on the torque of the screw. Generally, bigger-sized screws can carry more torque and apply a larger screw force P. However, screws with a smaller head-cap are easier to torque or tighten, which can be desirable. At a constant friction and screw force P, a steeper (i.e., smaller) taper angle α results in a higher clamp force Q. Thus, smaller screws or bolts 240 can be used with a steeply inclined cleat wall 220 to achieve substantially the same amount of clamp force Q as in a cleat with larger screws and a wall that is inclined at a more moderate angle. In this sense, the wedge-shaped cleat wall 220 of the cleat 80 can multiply the clamp force Q.

Figure 6:
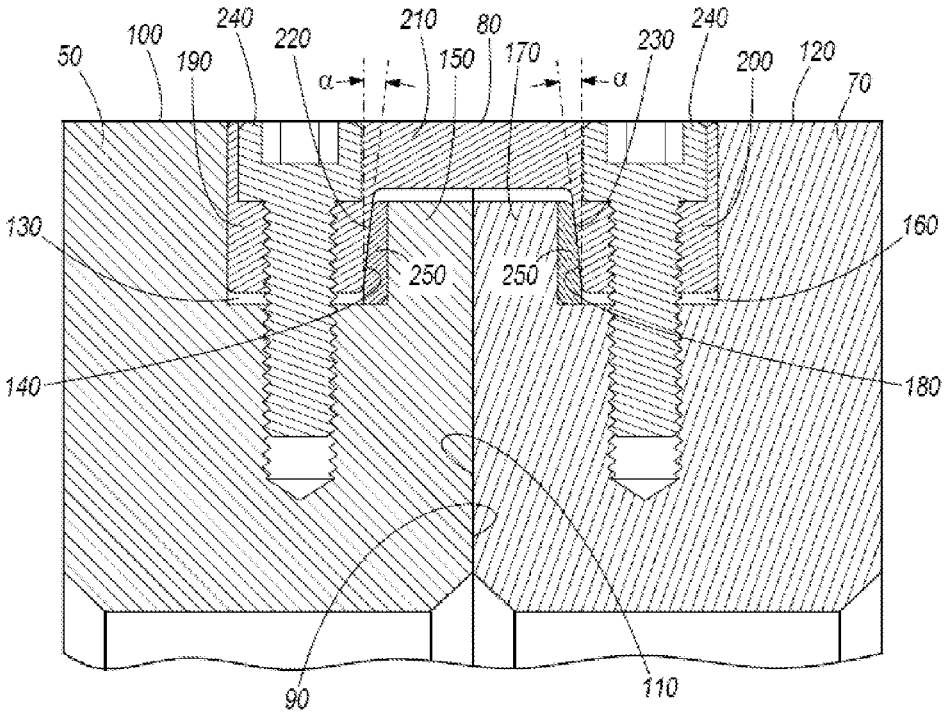
FIG. 6 is a sectional view of a shearer mining machine according to another embodiment of the invention.
Figure 7:
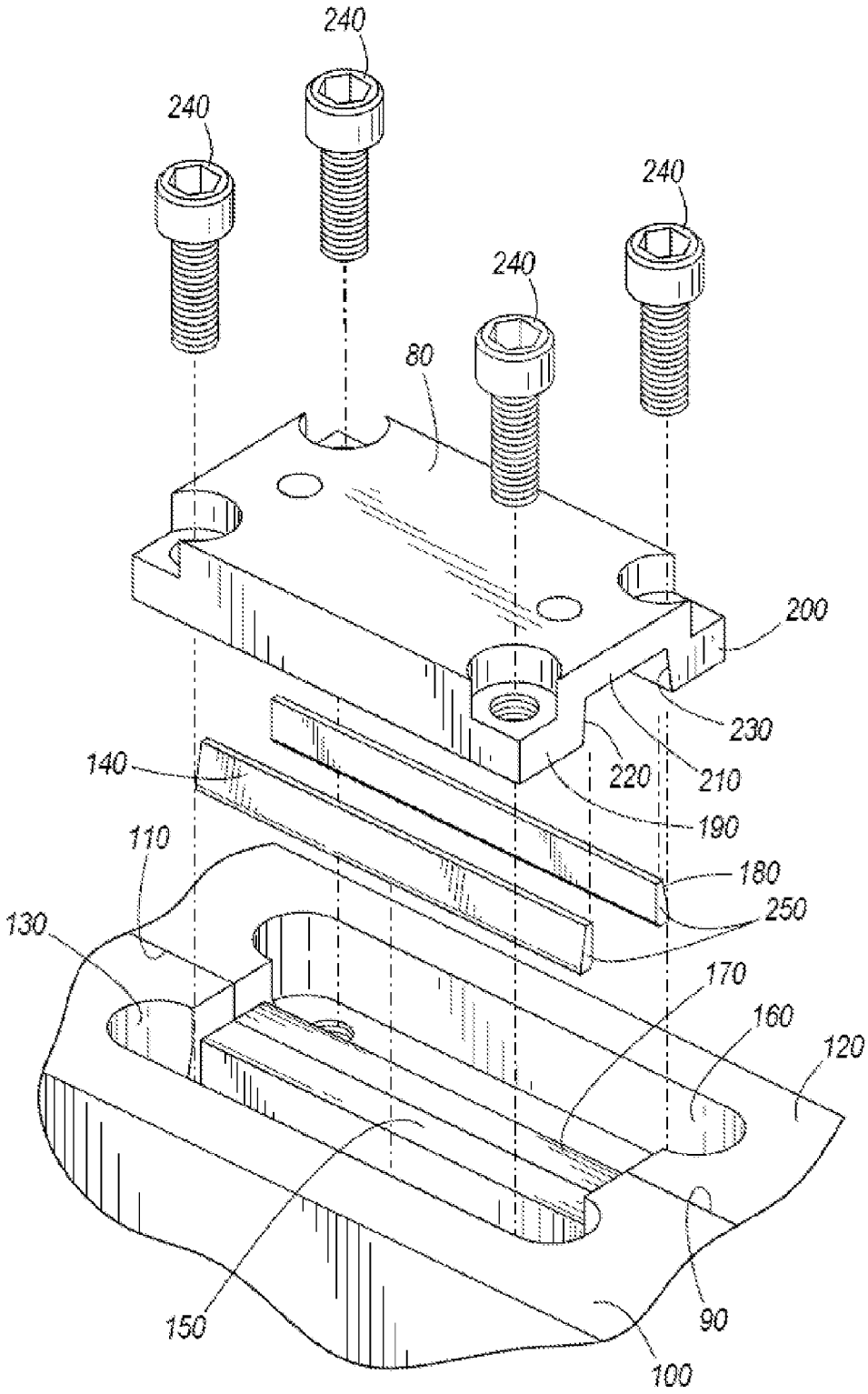
FIG. 7 is a perspective exploded view illustrating the cleat of FIG. 6 going into openings on the shearer mining machine.

FIG. 6 illustrates the shearer mining machine 10 according to another embodiment of the invention. Like parts are identified using like reference numerals. Referring also to FIG. 7, the shearer mining machine 10 in this embodiment includes a tapered insert 250. In the illustrated embodiment, the first and second openings 130, 160 are cuboidal. Separate from the first and second openings 130, 160, a tapered insert 250 is provided. The tapered insert 250 has a desired taper angle α machined into it. In the illustrated embodiment, the shearer mining machine 10 includes two tapered inserts 250, one in the first opening 130 and the other in the second opening 160. In other embodiments, however, the shearer mining machine 10 may include a single insert 250. When fit in the first cuboidal opening 130, the tapered insert 250 defines the first wedge-shaped module wall 140. The cleat 80 is then screwed on and engages the so-formed wedge-shaped module wall 140 to clamp the first and second mating surfaces 90, 110 together. Using a tapered insert 250 can make the machining of the opening 130 less complex. Moreover, using a tapered insert 250 provides the flexibility to change the taper angle α, thereby changing the clamp force Q without necessarily reworking the middle and side modules 50, 70. Although FIG. 6 illustrates the tapered inserts 250 fitting in cuboidal openings 130, 160 and engaging the first and second wedge-shaped cleat walls 220, 230, in other embodiments, similar tapered inserts 230 may instead fit on cuboidal projections 190, 200 of the cleat 80 to define wedge-shaped cleat walls 220, 230, which engage wedge-shaped module walls 140, 180 of the openings 130, 160, respectively, to clamp the first and second mating surfaces 90, 110 together.

Although the invention has been described in detail with reference to certain preferred embodiments, variations and modifications exist within the scope and spirit of one or more independent aspects of the invention as described.

What is claimed is:

1. A shearer mining machine comprising:

a first chassis module having a first mating surface, a first outer surface, and a first opening spaced from the first mating surface and recessed with respect to the first outer surface, the first opening defined by a first wedge-shaped module wall positioned adjacent the first mating surface;

a second chassis module having a second mating surface, a second outer surface, and a second opening spaced from the second mating surface and recessed with respect to the second outer surface; and a cleat including a first projection received by the first opening and including a first wedge-shaped cleat wall for engagement with the first wedge-shaped module wall, a second projection received by the second opening, and a bridge portion extending between the first projection and the second projection, wherein upon insertion of the first and second projections into the first and second openings, the first wedge-shaped module wall cooperates with the first wedge-shaped cleat wall to clamp the first and second mating surfaces together.

2. The shearer mining machine of claim 1, wherein the second opening is defined by a second wedge-shaped module wall.

3. The shearer mining machine of claim 2, wherein the first and second wedge-shaped module walls are substantially symmetrical from a view along the first and second mating surfaces.

4. The shearer mining machine of claim 2, wherein the second projection of the cleat includes a second wedge-shaped cleat wall for engagement with the second wedge-shaped module wall.

5. The shearer mining machine of claim 1 further comprising a tapered insert, the tapered insert defining the first wedge-shaped module wall.

6. The shearer mining machine of claim 1, wherein the first and second openings are of substantially the same height relative to the respective outer surfaces.

7. The shearer mining machine of claim 1, wherein the first and second openings are of substantially the same length.

8. The shearer mining machine of claim 1, wherein the first and second chassis modules each define a flange extending between the respective openings and mating surfaces, and each flange is received by the bridge portion of the cleat.

9. The shearer mining machine of claim 8, wherein the flanges are substantially symmetrical from a view along the first and second mating surfaces.

10. The shearer mining machine of claim 1, wherein the first and second projections of the cleat are substantially symmetrical from a view along the bridge portion.

11. The shearer mining machine of claim 1, further comprising a fastener for securing the cleat on the first and second chassis modules.

12. The shearer mining machine of claim 1, further comprising a means for securing the cleat on the first and second chassis modules.

13. A shearer mining machine comprising:

a first chassis module having a first mating surface and a first opening spaced from the first mating surface, the first opening defined by a first wedge-shaped module wall positioned adjacent the first mating surface;

a second chassis module having a second mating surface and a second opening spaced from the second mating surface;

one or more cleats, each cleat including a first projection received by the first opening and including a wedge-shaped cleat wall for engagement with the first wedge-shaped module wall, a second projection received by the second opening, and a bridge portion extending between the first projection and the second projection; and means for securing each cleat on the first and second chassis modules, wherein the means for securing applies a clamp force normal to the wedge-shaped cleat wall.

14. The shearer mining machine of claim 13, wherein the first and second chassis module each define a flange extending between the respective openings and mating surfaces, and each flange is positioned within the bridge portion of the cleat when the cleat is secured to the first and second chassis modules.

15. The shearer mining machine of claim 14, wherein the flanges are substantially symmetrical from a view along the first and second mating surfaces.

16. The shearer mining machine of claim 13, wherein the second opening is defined by a second wedge-shaped module wall.

17. The shearer mining machine of claim 16, wherein the first and second wedge-shaped module walls are substantially symmetrical from a view along the first and second mating surfaces.

18. The shearer mining machine of claim 13, wherein the first and second projections of the cleat are substantially symmetrical from a view along the bridge portion.

19. The shearer mining machine of claim 13, wherein the means for securing includes a plurality of fasteners.

20. The shearer mining machine of claim 19, wherein the fasteners include screws.

21. A shearer mining machine comprising:

a pair of chassis modules, the chassis modules adjoining each other, each chassis module defining a mating surface, an outer surface, and an opening spaced from the mating surface and recessed with respect to the outer surface, the opening defined by a wedge-shaped module wall positioned adjacent the mating surface; and a cleat, the cleat insertable to the openings, and the cleat including two projections, each projection received by the respective opening and including wedge-shaped cleat walls for engagement with the respective wedge-shaped module walls, and a bridge portion extending between the two projections, wherein upon insertion of the projections into the openings, the wedge-shaped module walls cooperate with the wedge-shaped cleat walls to clamp the mating surfaces together.

* * * * *